US008813994B2

(12) United States Patent
Ng

(10) Patent No.: US 8,813,994 B2
(45) Date of Patent: Aug. 26, 2014

(54) PORTION CONTROL FOOD WARE

(76) Inventor: Sally Ng, San Francisco, CA (US)

( * ) Notice: Subject to any disclaimer, the term of this patent is extended or adjusted under 35 U.S.C. 154(b) by 274 days.

(21) Appl. No.: 13/290,961

(22) Filed: Nov. 7, 2011

(65) Prior Publication Data

US 2013/0112583 A1 May 9, 2013

(51) Int. Cl.

| | |
|---|---|
| ***A47G 19/00*** | (2006.01) |
| ***A45C 11/20*** | (2006.01) |
| ***A47G 19/22*** | (2006.01) |
| ***A47G 19/02*** | (2006.01) |

(52) U.S. Cl.

CPC ..... *A47G 19/2227* (2013.01); *A47G 19/025* (2013.01)

USPC ..... 220/575; 206/541; 220/574

(58) Field of Classification Search

USPC ..... 206/217, 459.5, 541, 553; 220/573.1, 220/574, 574.1, 575, 592.17

See application file for complete search history.

(56) References Cited

U.S. PATENT DOCUMENTS

| | | | | |
|---|---|---|---|---|
| 4,461,396 | A * | 7/1984 | Harper | 220/23.83 |
| 5,111,960 | A * | 5/1992 | Zilliox | 220/575 |
| 5,743,402 | A * | 4/1998 | Gics | 206/459.5 |
| 5,775,570 | A * | 7/1998 | Kim | 206/217 |
| 7,207,459 | B1 * | 4/2007 | Latvis et al. | 220/574 |
| 2010/0072099 | A1 * | 3/2010 | Klein | 206/459.5 |

* cited by examiner

*Primary Examiner* — Luan K Bui

(74) *Attorney, Agent, or Firm* — Ray K. Shahani, Esq.; Leo H. K. Lai

(57) ABSTRACT

A kit containing portion control tableware, the kit containing a portion control plate and a portion control drinking cup, whereby when used, the portion control cup limits the amount of beverage consumed to a healthy portion size, and the portion control plate provides a visual indication of the size of a healthy portion.

11 Claims, 12 Drawing Sheets

100

100

200

200

300

PORTION CONTROL FOOD WARE

RELATED APPLICATIONS

None.

FIELD OF THE INVENTION

The present invention relates to portion control food ware, and more particularly, to portion control food and drink containers that require users moderate their intake.

BACKGROUND OF THE INVENTION

Obesity is an epidemic that will affect 1 in 3 Americans. It is estimated that today, $1.47 billion is spent annually on healthcare treating obesity related illnesses and conditions that result from them. Obesity does not only alter the physical appearance, but greatly compromises their overall health, and increases risk of cancer, heart diseases, liver diseases, diabetes and a plethora of other diseases. Obesity is caused by a number of factors such as lack of education, social status, lifestyle, advertisements, parenting, physical condition, medical, psychological or emotional factors, etc.

One of key factors in obesity is the large portions of food and drinks that some people consume. Frequently restaurants serve extra-large portions of foods, which are commonly two to four times bigger than the government's recommended serving sizes.

Portion control is understanding how much a serving size is and how many calories a serving contains. Portion control is important for weight management, as weight is often related to total caloric intake. Healthy eating, even according to the philosophies and theories of ancient teachers including Aristotle, is the desirable middle between the extremes of excess and deficiency, i.e., over-eating and not eating enough, respectively, or the "golden mean". Portion control is generally characterized by or associated with eating a healthy balance of amount and types of foods. Portion sizes can be estimated by using objects as a point of reference. One way of determining portion size is to compare hand size. For example a healthy serving of protein should not be larger than a palm size piece of meat. Carbohydrate servings such as pasta can be measured by fistfuls. A healthy serving of pasta or rice should be one fistful.

The purpose of the present invention is to aim for the gradual and subtle change of eating behaviors through awareness of food intake and portion control. The goal of the present invention is to get users to eat approximately 20% less that they would otherwise have eaten or typically do eat. This concept is echoed by long living Okinawans in Japan and elsewhere who have a cultural eating philosophy or practice of "eat only until you're 80% full".

ADVANTAGES AND SUMMARY OF INVENTION

One object and advantage of the present invention is to provide a subtle, easy and friendly dinner and table ware for people who want to portion control their food and beverage intake.

Another object and advantage of the present invention is to provide a subtle and discreet way to remind users without making them self-conscious, even in a social setting.

Another object and advantage of the present invention is to provide a clear visual signal to a user when a healthy, desirable size of a portion is exceeded Yet another object and advantage of the present invention is provide an interactive way to encourage users to adhere to a diet plan.

Yet another object and advantage of the present invention is to provide eating portion ware having a specific, functional and unique structure, having advantages and benefits over and above existing generic portion ware.

Further details, objects and advantages of the present invention will become apparent through the following descriptions, and will be included and incorporated herein.

For a better understanding of the invention reference is made to the following detailed description of the preferred embodiments thereof which should be taken in conjunction with the prior described drawings.

DETAILED DESCRIPTION OF THE PREFERRED EMBODIMENT

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

For a better understanding of the invention reference is made to the following detailed description of the preferred embodiments thereof which should be taken in conjunction with the prior described drawings.

Figure 1A:
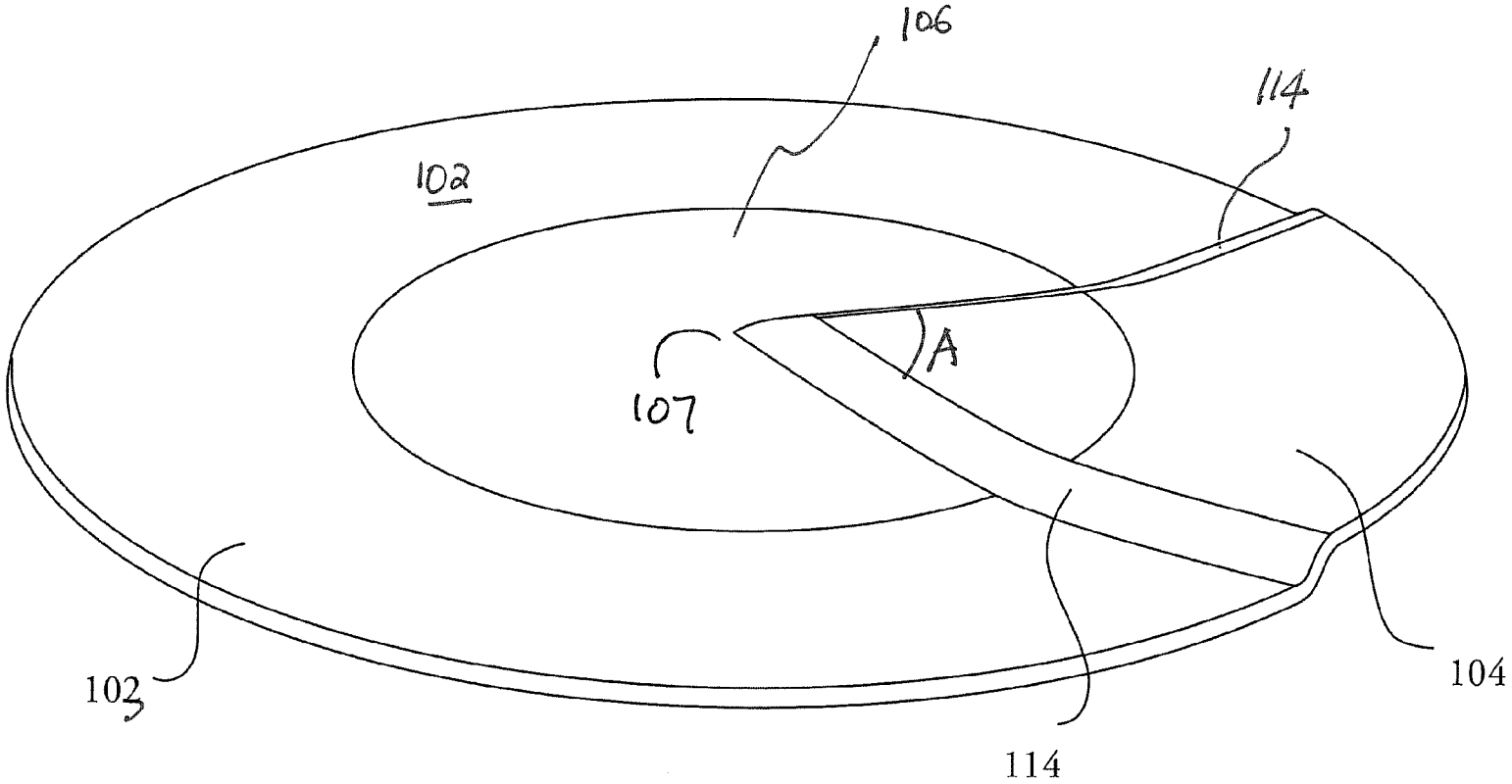
FIG. 1A is a representative top isometric view of portion control plate 100 of the present invention showing the top face 102.

FIG. 1A is a representative top isometric view of portion control plate 100 of the present invention showing the top face 102. As shown in FIG. 1A, portion control plate 100 resembles a regular dinner plate which is a circular, broad, concave, but mainly flat platter-like vessel on which food can be loaded and served. In one embodiment, the surface area of top face 102 is divided into two portions, viz. serving portion 103 and raised portion 104. In one embodiment, raised portion 104 is a sector of the circular top face 102, accounting for an approximate 20% of the total surface area. Thus, central angle A is approximately 72°.

As an important design element of portion control plate 100 of the present invention, raised portion 104 is visually distinctive to serving portion 102 in two ways. Firstly, raised portion 104 is painted in bright colors such as red and orange while serving portion 103 is painted in white or other neutral colors. Secondly, raised portion 104 is elevated by two slanting ridges 114 along the radii of raised portion 104. The combination of color contrast and elevated raised portion 104 provides a strong but yet subtle visual impact to user to remind them to consume less, approximately 20% of food intake. In one embodiment, the surface area of top face 102 is also divided into another two portions, viz. inner portion 106 and outer edge portion 105. As best shown in FIG. 1A, main inner portion 106 is the inner circle area of top face 102 and outer rim and edge portion 105 is the immediate ring surrounding the main inner portion 106. While largely a matter of choice for users, in general it is understood that users would load their food mainly within inner portion 106.

In alternative embodiments, portion control plate 100 can be in different sizes for different meals such as breakfasts, lunches, snacks, light lunches, etc. Also, in alternative embodiments, portion control plate 100 can be in other basic shapes such as oval, square, rectangle, etc. It will also be understood that in addition to a sector, the raised portion 104 can be a segment, circular, oval, rectangular, section, or any other defined segment or portion of the plate 100.

Figure 1B:
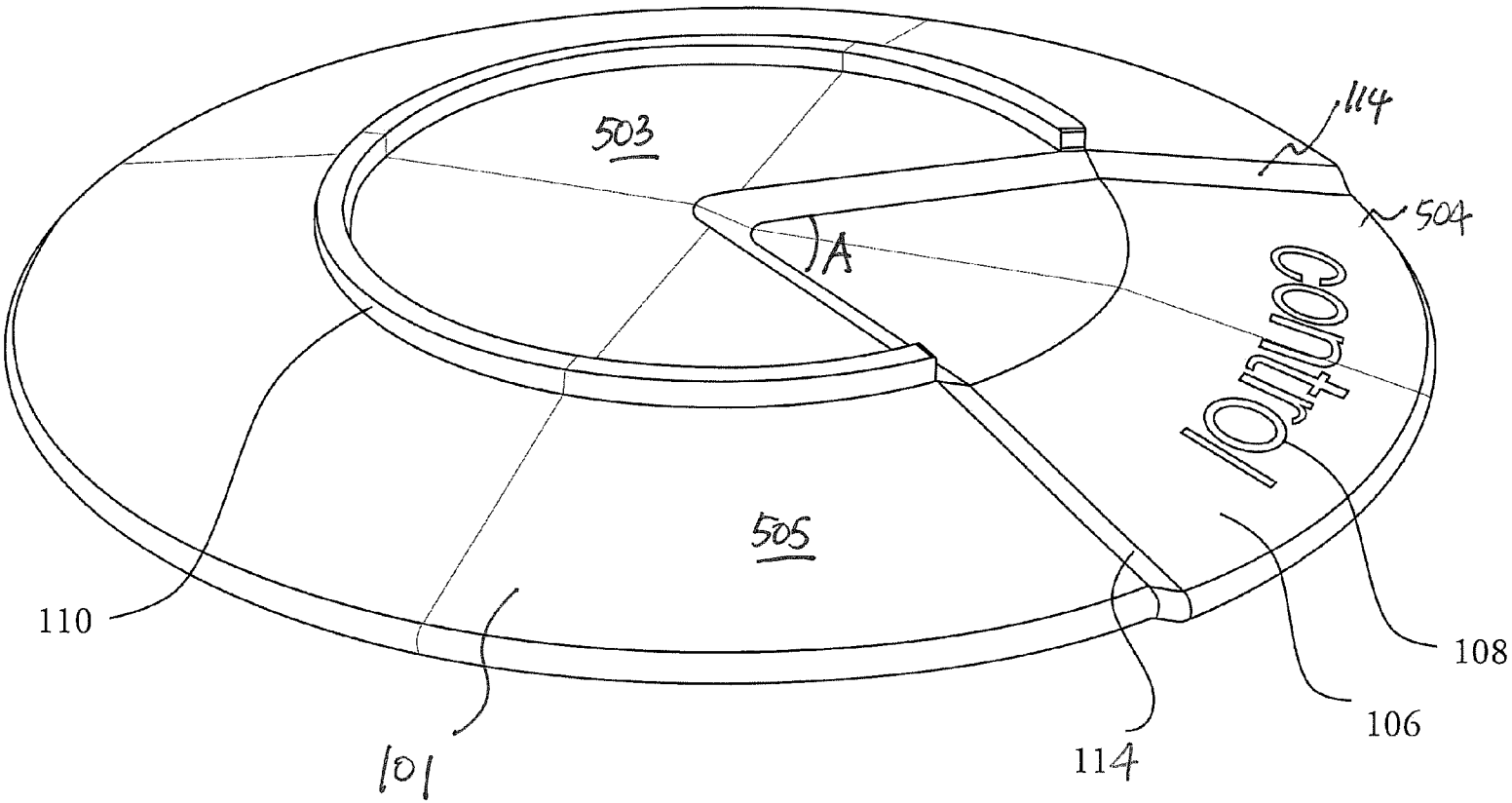
FIG. 1B is a representative isometric view of portion control plate 100 of the present invention showing the bottom face 101.

FIG. 1B is a representative isometric view of portion control plate 100 of the present invention showing the bottom face 101. As shown in FIG. 1B, bottom face 101 is a slight convex flat structure resembling the bottom of a regular dinner plate. In one embodiment, exactly the same as the top face 102, bottom face 101 is divided into inside portion 503 which is painted in white or a neutral color, outer edge 505, and bottom depressed portion 504 which can optionally be painted in a bright or contrasting color. In one embodiment, the locations and sizes of inside portion 503 and depressed portion 504 correspond with top serving portion 106 and top raised portion 104, respectively. As shown in FIG. 1B, depressed portion 504 appears as a depressed sector with a central angle A which is approximately 72°. As best shown in FIG. 1B, inner portion 503 and outer edge portion 505 is divided by circular plate foot 110. In one embodiment, plate foot 110 is a semi-circular ridge that runs along the circumference between bottom inner portion 503 outer portion 505. Foot 110 does not extend across the depressed portion 504, leaving the plate 100 intrinsically unstable when fully loaded in the right side up position. The main function of plate foot 110 is to provide support and stabilization to portion control plate 100 when it is placed sight side 102 up but not overloaded.

As best shown in FIG. 1B, reminder, encouragement or inspirational marking 108 is painted, stenciled and/or engraved within bottom depressed portion 504. Examples of effective empowering words includes but not limited to "Control", "Willpower", "Restrain", "Eat Less", etc. The main purpose of encouragement marking 108 is to provide a subtle reminder and inspiration to users to stay on their dietary plan, when they are preparing or serving themselves food. Although encouragement marking 108 is at the bottom of portion control plate 100, users will be able to see it when handling portion control plate 100, or when the plate 100 is overloaded and tips, and the subtlety of its location avoids awkward situations for users in social settings. In alternative embodiments, encouragement marking 108 can be customized graphics, poems, icons etc.

Figure 1C:
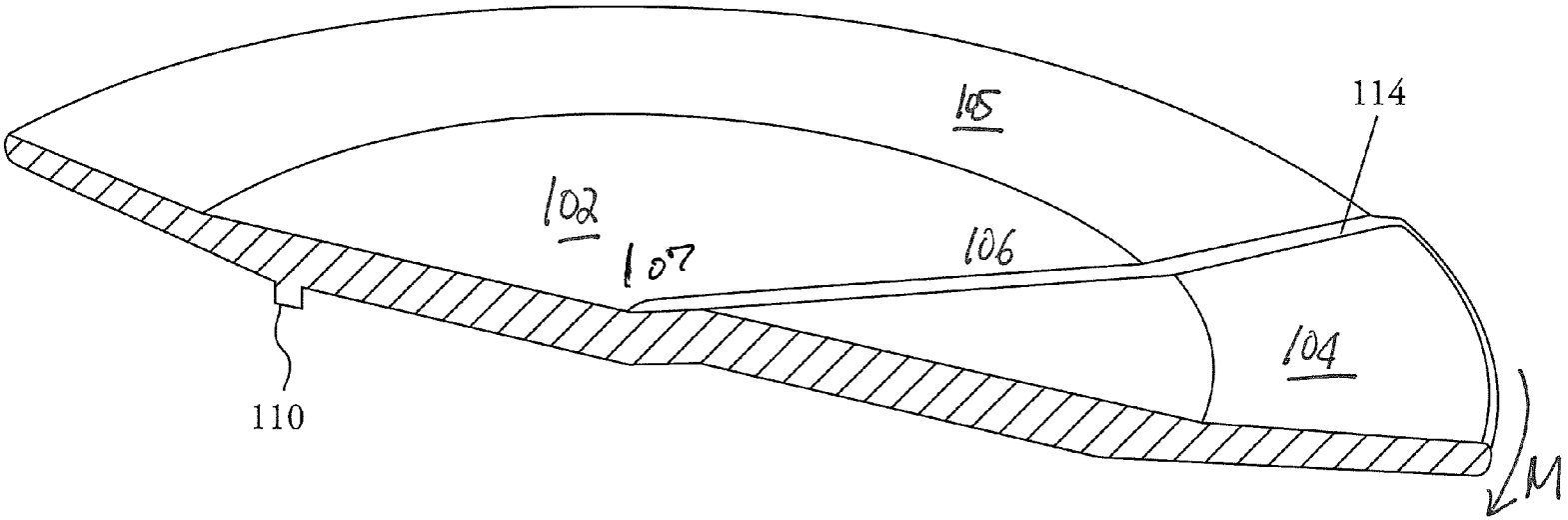
FIG. 1C is a representative cross-sectional view of portion control plate 100 of the present invention.

FIG. 1C is a representative cross-sectional view of portion control plate 100 of the present invention. As best shown in FIG. 1C, plate foot 110 is discontinued underneath the raised portion 104 of portion control plate 100. Thus, when too much food is loaded onto or outside of top inner portion 106, the entire portion control plate 100 will tilt in direction M. The inclination of portion control plate 100 provides another subtle but strong reminder to users that they have loaded on their plate, and therefore most probably will consume, too much food.

Figure 1D:
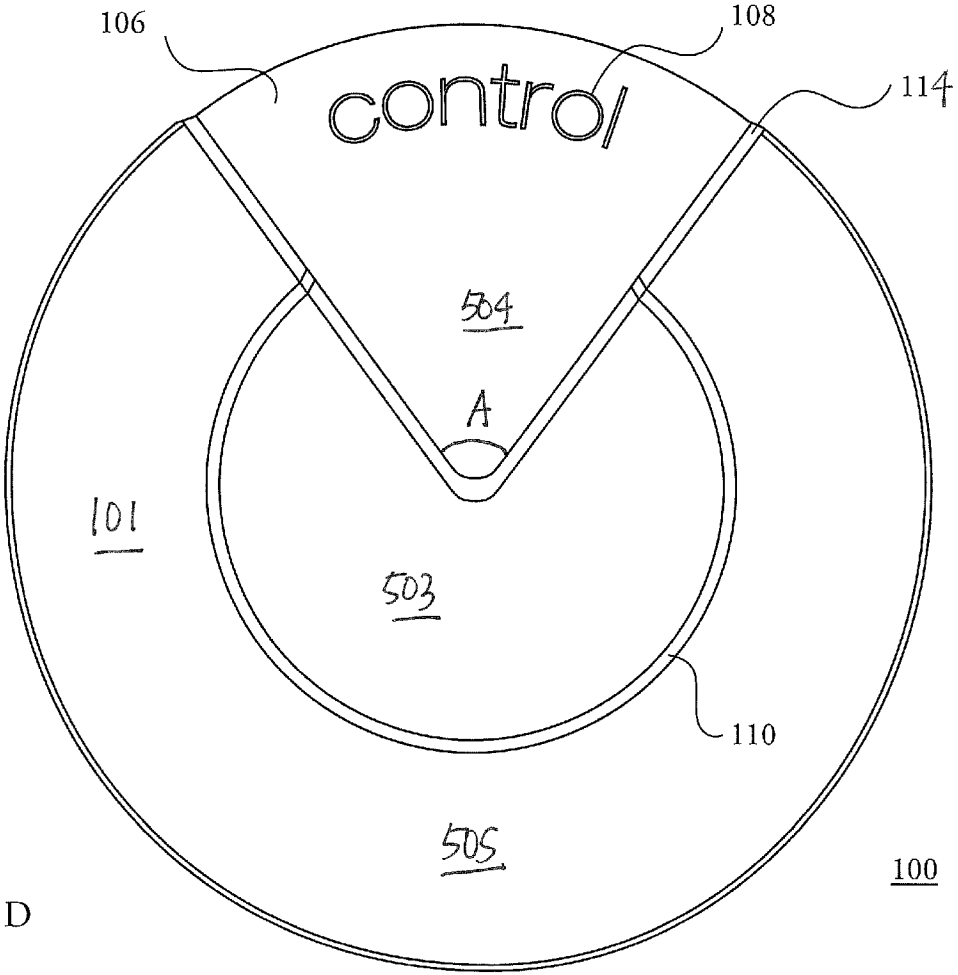
FIG. 1D is a representative lower view of portion control plate 100 of the present invention showing the bottom face 101.

FIG. 1D is a representative lower view of portion control plate 100 of the present invention showing the bottom face 101. When portion control plate 100 is not used, it can be stored upright and upside down, displaying encouragement marking 108.

It will be understood that a center of gravity for the portion control plate 100 of the present invention in the loaded with 80% portion, i.e., a controlled portion, keeps the plate 100 resting upon the discontinuous foot portion 110. However, upon loading food upon the raised portion 104, the combination of the increased elevation of the food placed on raised portion 104 and lack of foot portion 110 extending immediately below the raised portion 104 results in a shift of the center of gravity, thereby resulting in instability of the plate 100.

Figure 2A:
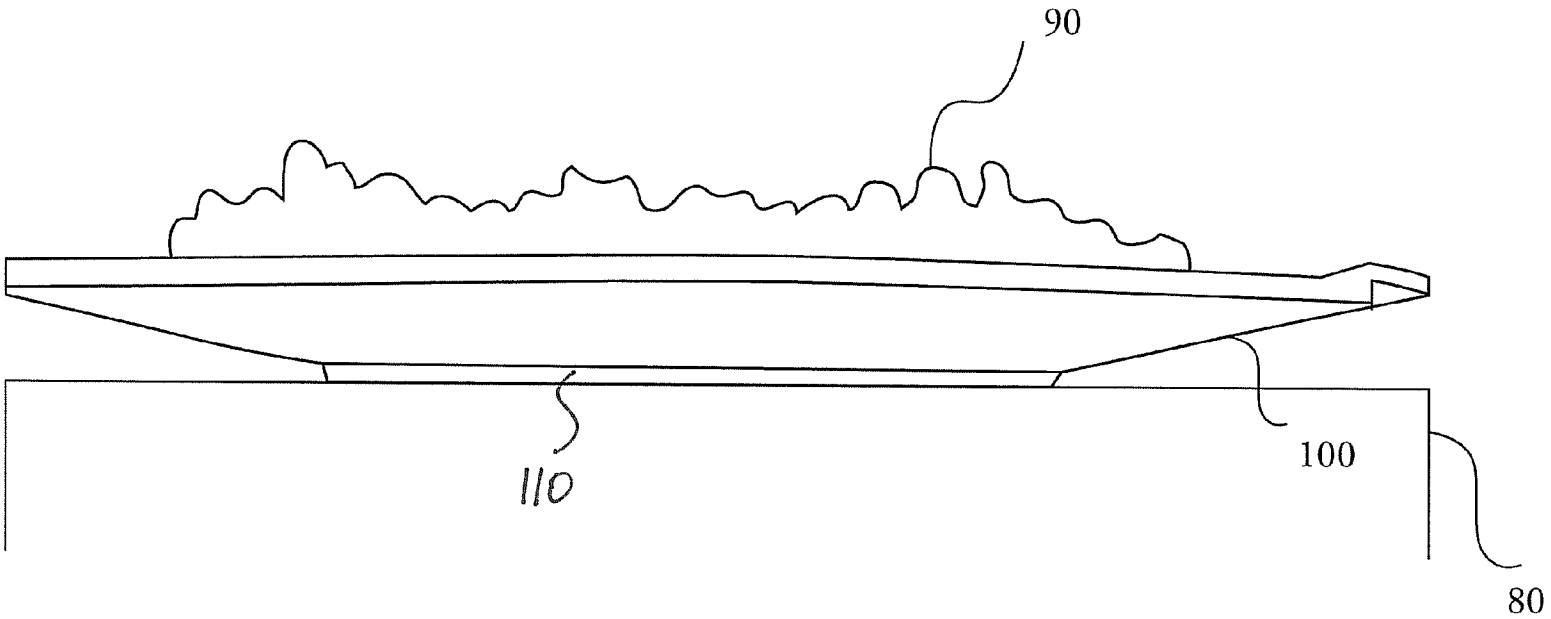
FIG. 2A is a representative schematic view showing a method of use of portion control plate 100 of the present invention.

FIG. 2A is a representative schematic view showing a method of use of portion control plate 100 of the present invention. As best shown in FIG. 2A, when users load appropriate amount of food onto the portion control plate 100 and mostly within upper inner portion 106, portion control plate 100 is standing upright despite having no support underneath raised portion 104. When food is loaded starting from the center 107 of the plate 100, tipping occurs when a portion greater than 80% of a healthy portion is served. As the food is distributed outwardly starting from the center 107, the center of gravity will shift and tilt the portion control plate 100 in the direction toward the raised, elevated portion 104 resulting in instability of the plate 100 and shift of center of gravity thereof to somewhere within or underneath the raised portion 104.

Figure 2B:
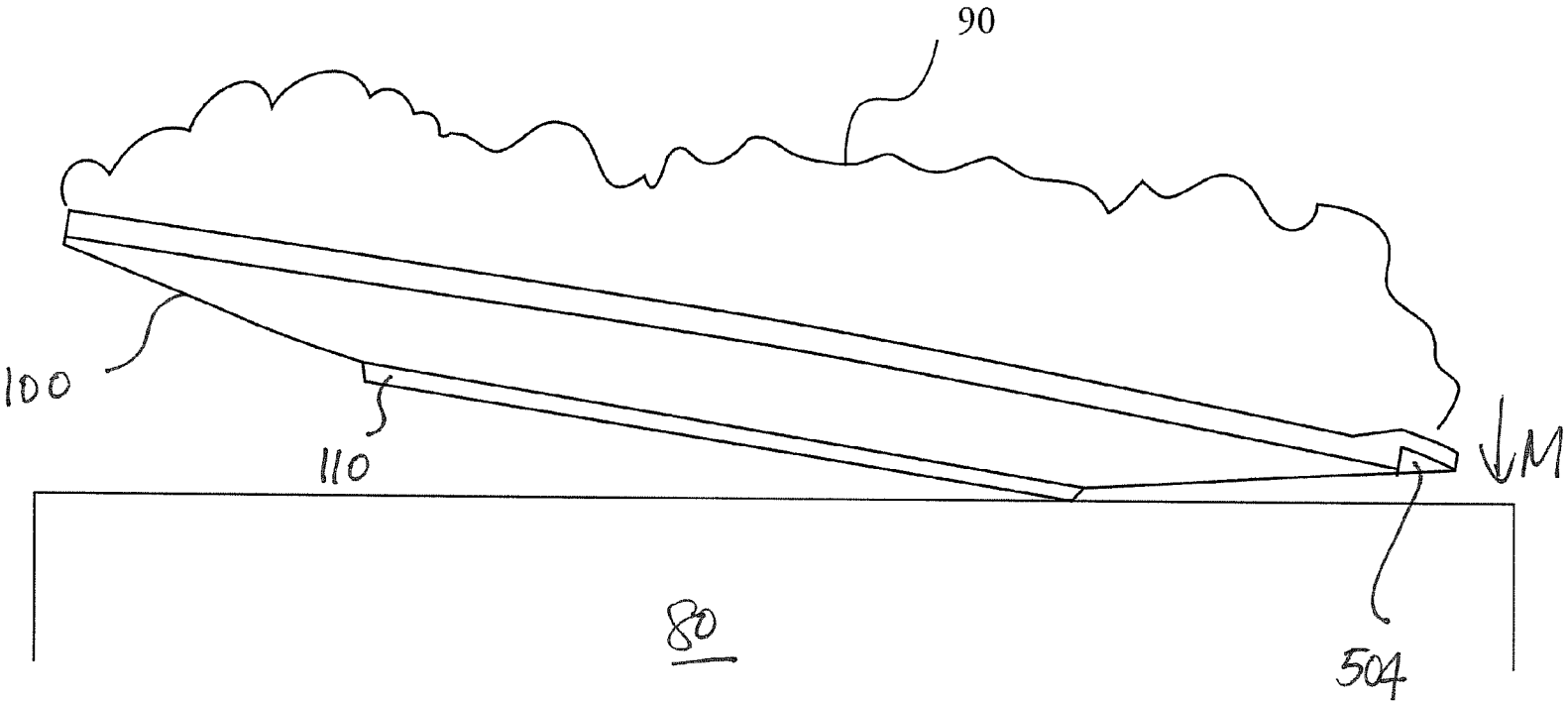
FIG. 2B is a representative schematic view showing a method of use of portion control plate 100 of the present invention in the tipping mode.

FIG. 2B is a representative schematic view showing a method of use of portion control plate 100 of the present invention in the tipping mode. As shown, when too much food is loaded on portion control plate 100 until it overflows onto upper outer edge portion 105, the entire portion control plate 100 will tilted towards raised portion 104 in direction M. The slight tilting of portion control plate 100 serves as a powerful visual reminder to users that too much food has been loaded onto the plate 100.

Figure 3A:
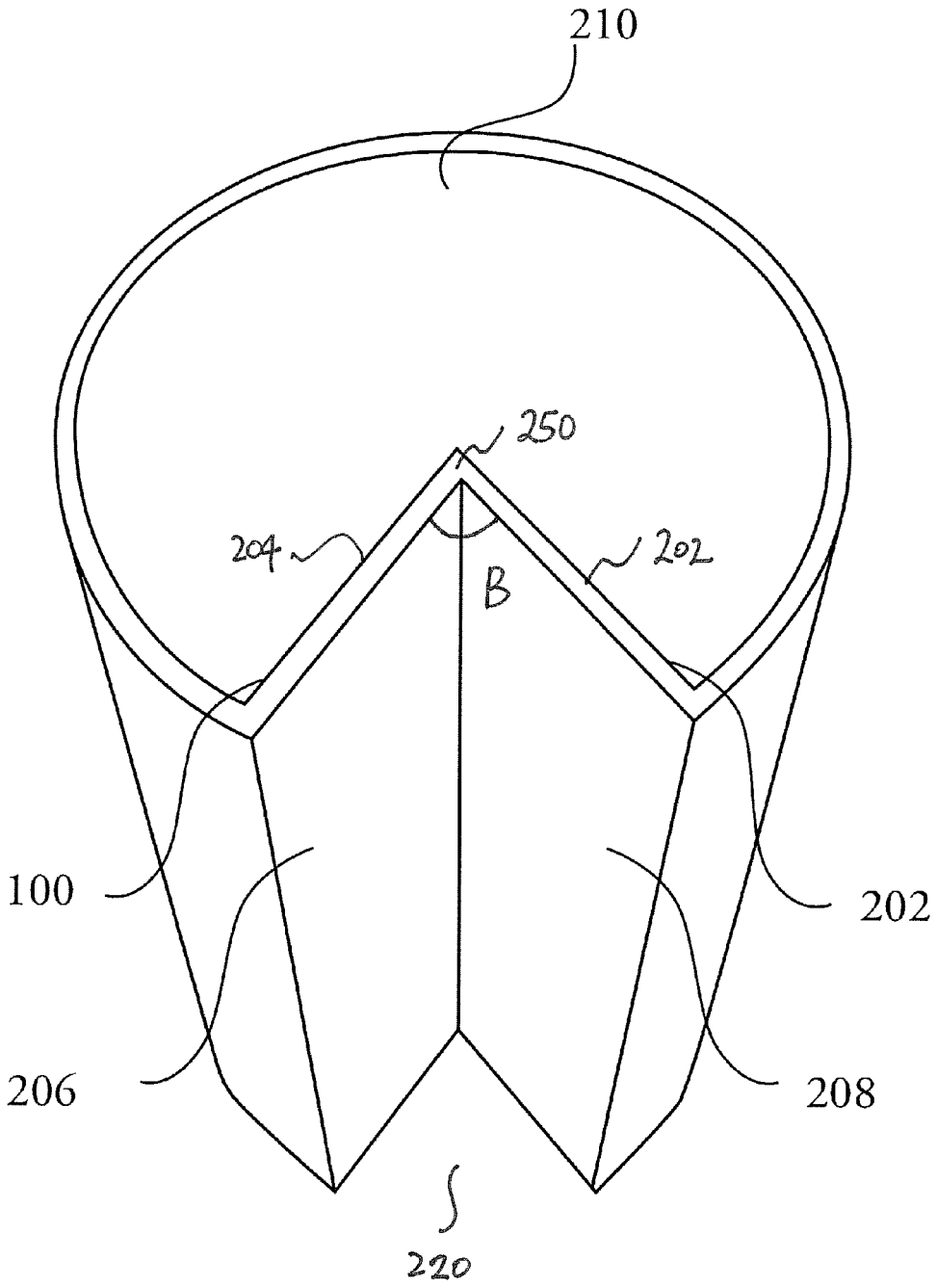
FIGS. 3A and 3B are representative top isometric view and side view respectively of portion control cup 200 of the present invention.
Figure 3B:
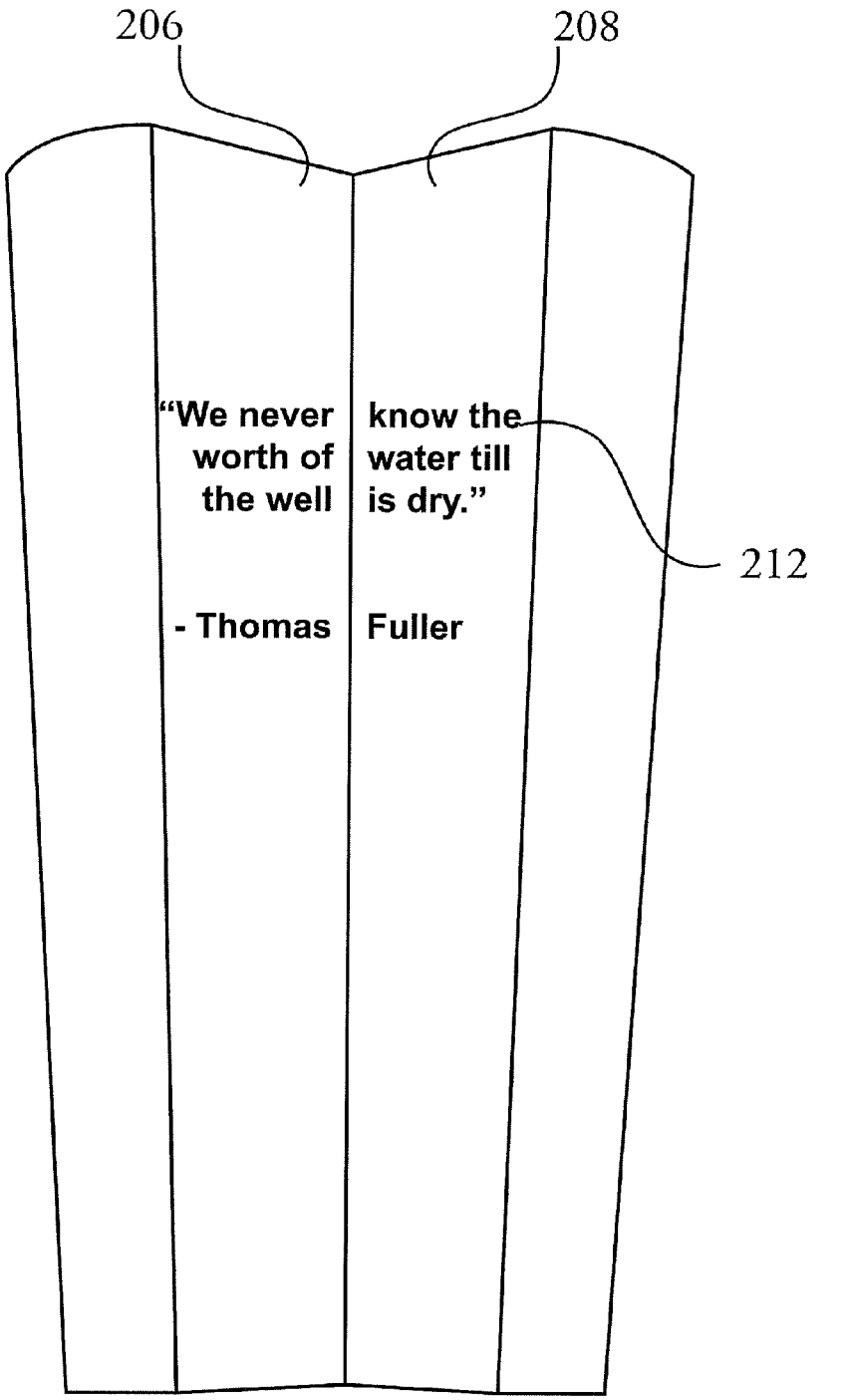

FIGS. 3A and 3B are representative top isometric view and side view respectively of portion control cup 200 of the present invention. Other than solid food intake, portion control on beverages is also imperative in diet plans since many beverages such as soft drinks, wines, spirits, etc., contain substantial calories. These calories are mainly supplied by sugar, alcohol, juices and other sweetened drinks. The main purpose of portion control cup 200 is to limit beverage intake of users by reducing the volume of a beverage container by approximately 20%. In one embodiment, portion control cup 200 resembles a regular tall drinking cup, with one sector-shaped column 220 removed. As shown in FIG. 3A, portion control cup 200 has an incomplete or discontinuous circular outer lip or shell 203 which is connected integrally to left plane 206 and right plane 208, both planes 206 and 208 extending towards and eventually meeting at the center point 250 of the portion control cup 200. The angle between the two inverted planes 206 and 208 is B, which is approximately 72°. The missing sectional column 220 accounts for approximately 20% volume of a regular drinking cup of similar dimension.

It will be understood that the portion control can be varied, i.e., portion cups 200 can be designed which reduce the portion by 10%, 15%, 25%, 30%, or more or less as desired. furthermore, the shape of the reserved portion 220 can be varied as well, to include shapes such as circular, segmented, or other as desired.

Figure 3C:
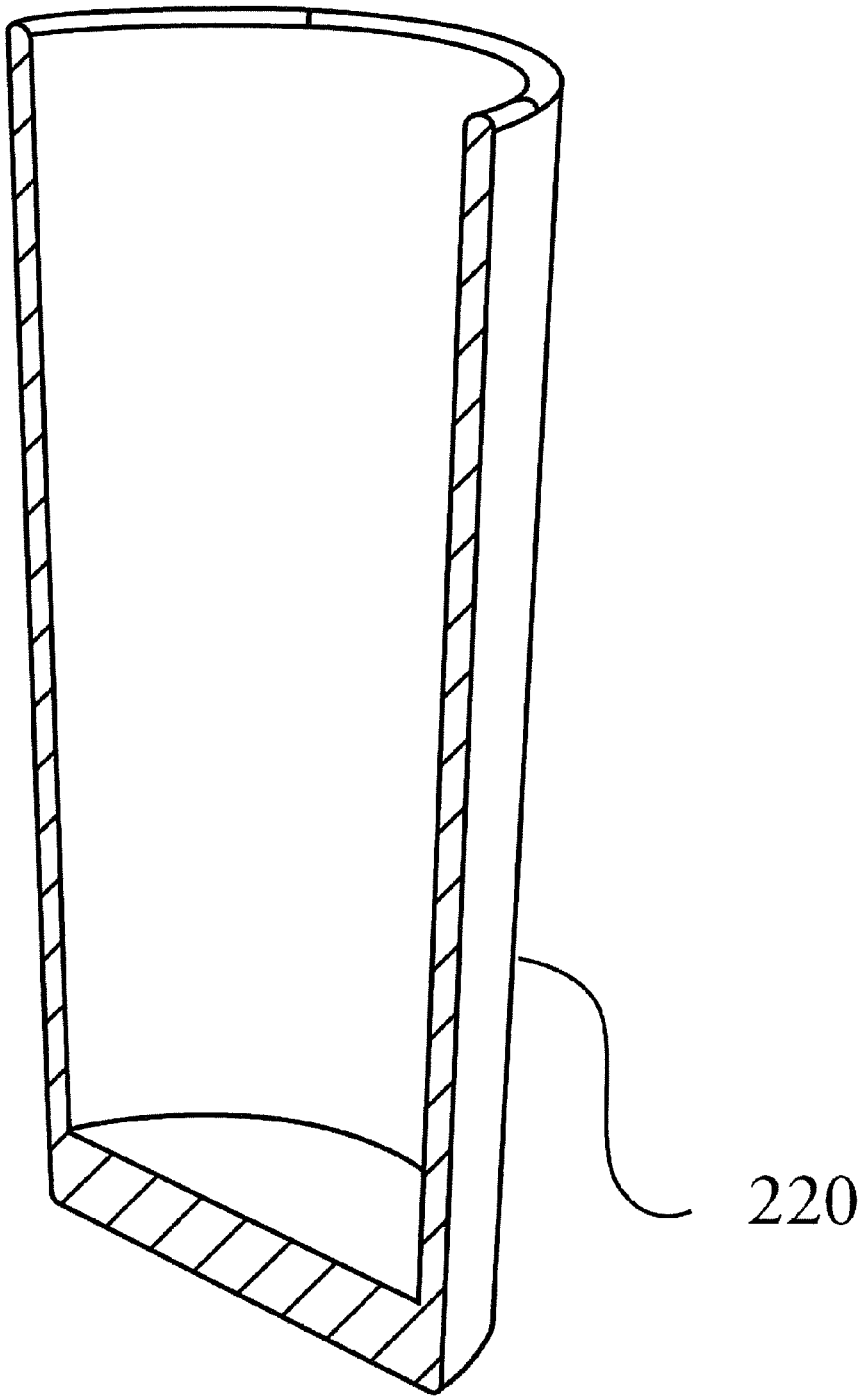
FIGS. 3C and 3D are representative right-side and left-side cross-sectional view respectively of portion control cup 200 of the present invention.
Figure 3D:
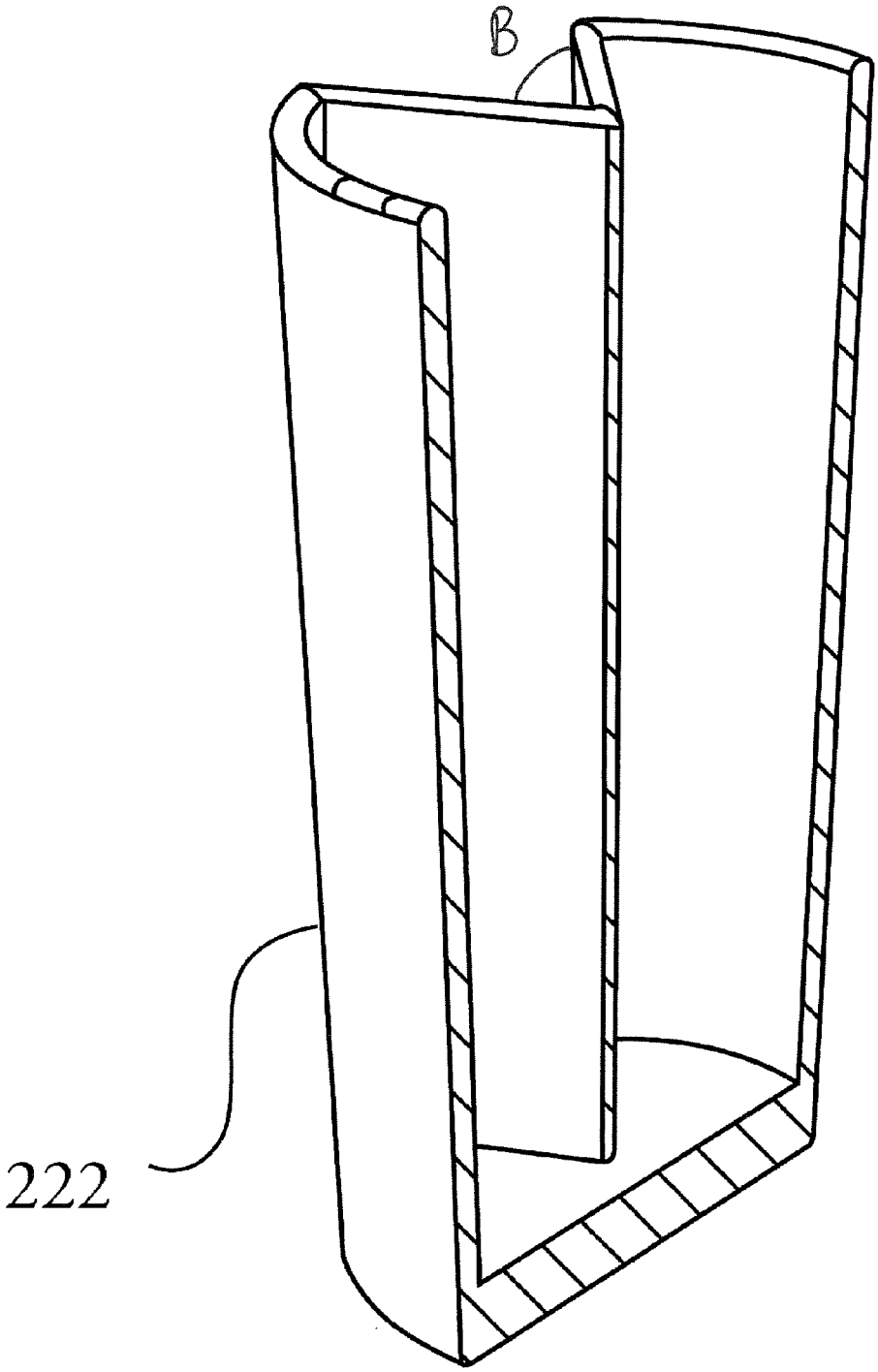

FIGS. 3C and 3D are representative right-side and left-side cross-sectional view respectively of portion control cup 200 of the present invention. As best shown in FIG. 3B, left plane 206 and right plane 208, collectively provide an area where cup encouragement marking 212 can be painted, stenciled and/or embossed on. In one embodiment, cup encouragement marking 212 can be any standard or customized encouraging and empowering words, verses, poems that motivate users to stay on their diet plans and/or consume more pure water. Examples include but are not limited to "We never know the worth of water till the well is dry—Thomas Fuller", as best shown in FIG. 3B. As shown in FIG. 3D, right plane 206 and left plane meet at an angle B. The shape angle B may make cleaning the inside of portion control cup 200 difficult. In an alternative embodiment, smoother inside contour can be provided in order to facilitate cleaning.

Figure 4A:
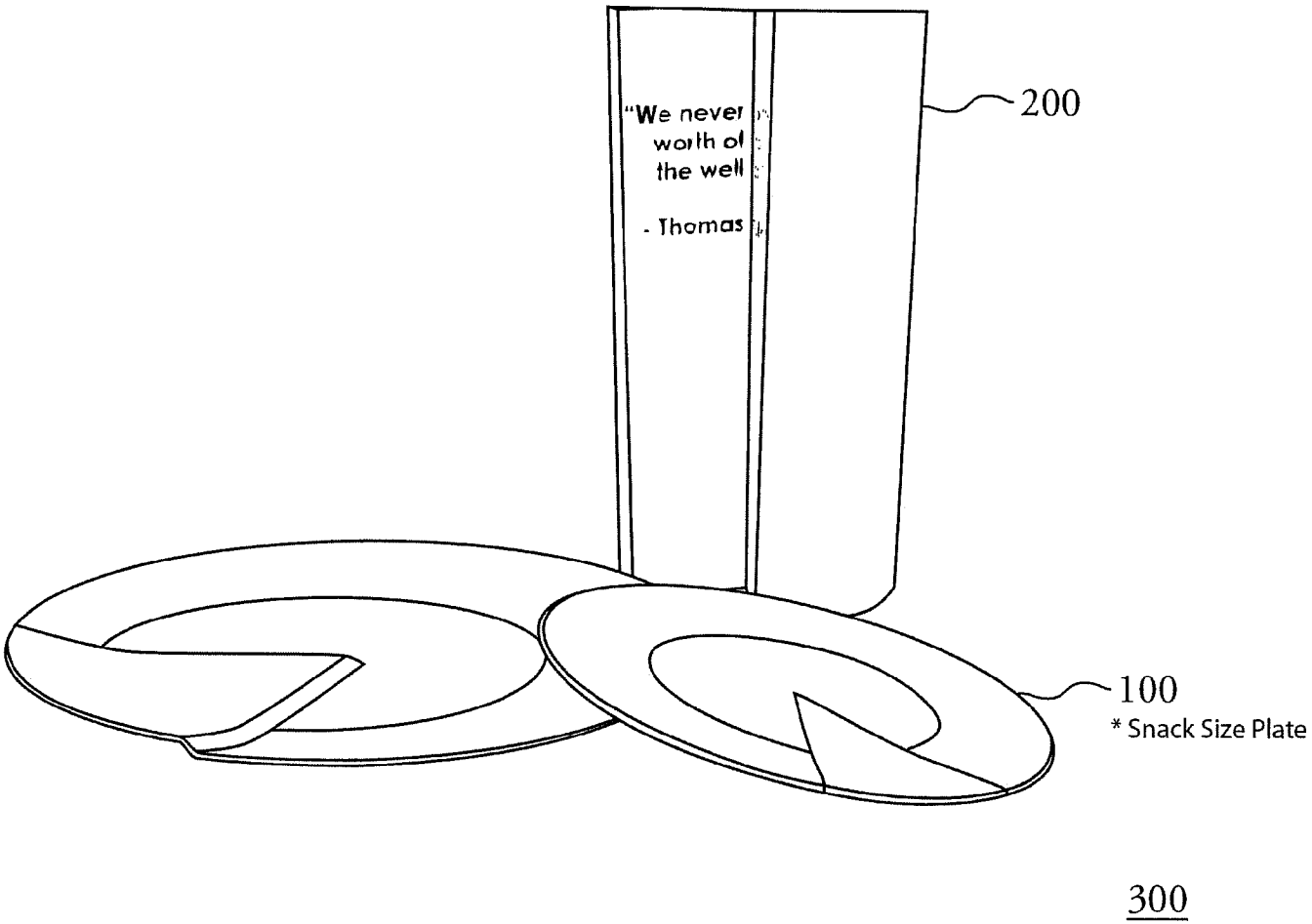
FIGS. 4A and 4B are representative isometric views of portion control dinner and table ware system 300 of the present invention.
Figure 4B:
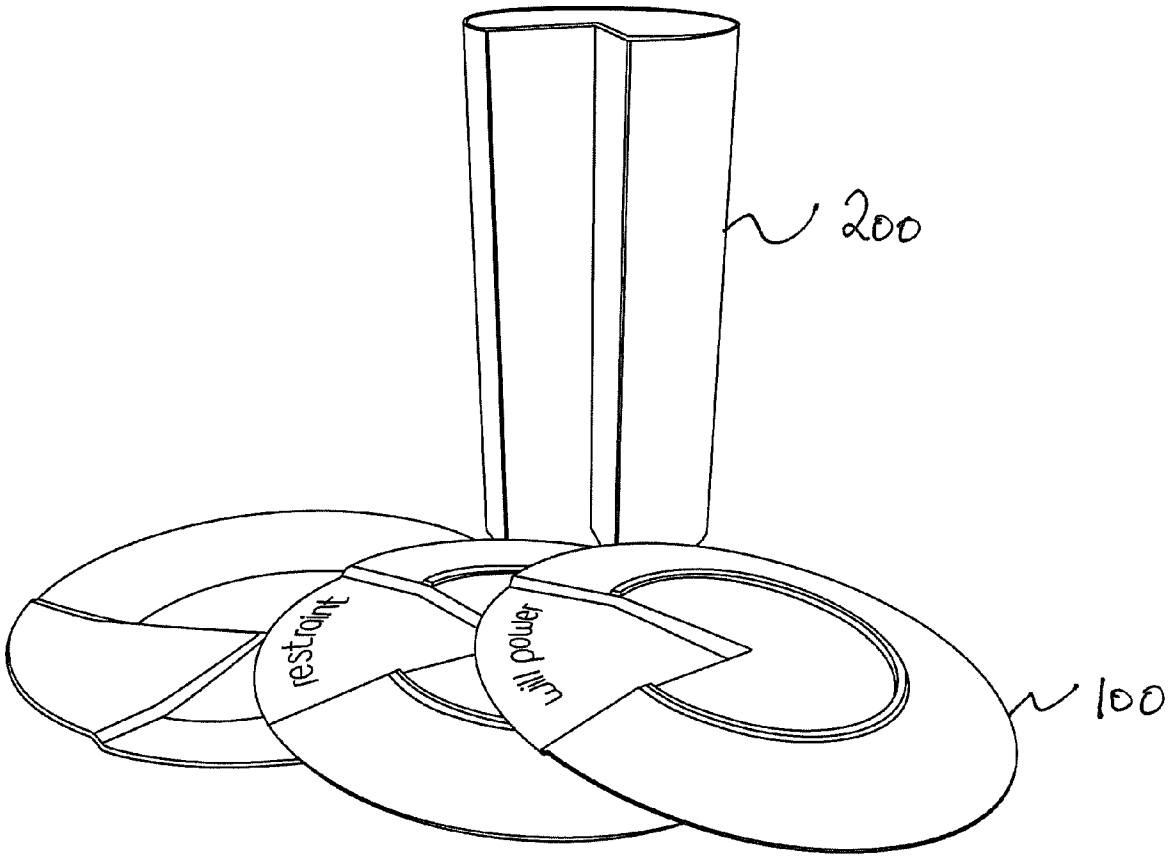

FIGS. 4A and 4B are representative isometric views of portion control dinner and table ware system 300 of the present invention. In one embodiment, portion control dinner and table ware system 300 contains a complete set of portion control cups 200 in various sizes and a plurality of portion control plates 100 in various sizes and shapes. While it is effective to use portion control plates 100 and portion control cups 200 separately, users can use them in conjunction with each other to facilitate compliance with a diet, achievement of body weight objectives, etc.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A portion control plate for reducing the size of the portion served thereon, the portion control plate comprising:

a predominantly flat and slightly concave upper surface having a predetermined shape, the upper surface further divided into a major sector portion and a minor sector portion, the minor sector portion further raised slightly above the level of the major sector portion, the upper surface being continuous across its entire surface;

a predominantly flat and slightly convex lower surface formed integrally with the upper surface, further having a predetermined shape, the lower surface further divided into a major sector portion and a minor sector portion, the sector portions of the lower surface matching with the sector portions of the upper surface, the major sector of the lower surface further comprising a narrow peripheral, circumferential supporting foot for supporting the portion control plate upon any flat surface, the supporting foot continuous across the major sector of the lower surface and discontinuous across the region defining the minor sector portion; and two centers of gravity such that a first center of gravity keeps the plate resting upon the discontinuous foot when food is loaded onto the flat upper surface of the plate but not the raised, minor sector portion thereof, and a second center of gravity that causes the portion control plate to tilt toward the raised minor sector portion when the upper raised minor sector portion is loaded with food, thus providing a visual indicator that the portion served exceeds a maximum healthy portion size.

2. The portion control plate of claim 1 in which the predetermined shape of the upper surface and lower surface is selected from the group consisting of circular, oval, hexagonal, square and rectangular.

3. The portion control plate of claim 1 in which a visual marking is placed on the minor sector portion of the lower surface.

4. The portion control plate of claim 3 in which the visual marking is words and sentences of encouragement and enlightenment.

5. The portion control plate of claim 3 in which the visual marking is painted and stenciled on.

6. The portion control plate of claim 3 in which the visual marking is engraved.

7. The portion control plate of claim 1 in which the minor sectors of both the upper surface and lower surface further having a bright surface color.

8. The portion control plate of claim 1 in which slanting edges define the interface between the minor sector portion and the major sector portion of the upper surface, thereby facilitating removal of food placed thereon.

9. The portion control plate of claim 1 in which the minor sector portion of the upper surface is raised above the level of the major sector portion a height of between about 3 mm and about 20 mm.

10. The portion control plate of claim 1 in which the area of the minor sector portion comprises between approximately 10% and approximately 30% of the upper surface.

11. The portion control plate of claim 1 in which the area of the minor sector portion comprises approximately 20% of the upper surface.

* * * * *